United States Patent [19]

Lindow et al.

[11] Patent Number: 4,988,150

[45] Date of Patent: Jan. 29, 1991

[54] KEYBOARD STAND

[76] Inventors: Curnal Lindow, 220-29 101st Ave., Queens Village, N.Y. 11429; George Spector, 233 Broadway #3815, New York, N.Y. 10007

[21] Appl. No.: 429,134

[22] Filed: Oct. 30, 1989

[51] Int. Cl.[5] ..... A47B 91/00

[52] U.S. Cl. ..... 312/256; 108/159; 248/151

[58] Field of Search ..... 84/423, 423 A, 401, 84/181, 177, 180; 108/159, 157, 25; 312/256, 241, 223, 208; 248/188, 188.1, 188.8, 151; 446/408, 143, 482

[56] References Cited

U.S. PATENT DOCUMENTS

| | | | |
|---|---|---|---|
| 979,123 | 12/1910 | Bohrer | 248/151 |
| 1,790,008 | 1/1931 | Janssen | 84/180 |
| 1,967,979 | 7/1934 | Stern | 108/25 X |
| 2,564,338 | 8/1957 | McCarroll | 108/25 X |
| 2,697,460 | 12/1954 | Barnett | 312/241 X |
| 3,001,843 | 9/1961 | Davis | 108/157 X |
| 3,516,633 | 6/1970 | Blackwood | 248/188 |
| 4,102,468 | 7/1978 | Goldman | 248/151 X |
| 4,127,051 | 11/1978 | Conklin | 84/430 X |

*Primary Examiner*—Joseph Falk

[57] ABSTRACT

A knock-down keyboard stand is provided and consists of legs that can be removed from a table top and be stored within a compartment in the bottom of the table top to make the stand compact when not in use.

1 Claim, 1 Drawing Sheet

07/42

KEYBOARD STAND

BACKGROUND OF THE INVENTION

The instant invention relates generally to portable musical instrument stands and more specifically it relates to a knock-down keyboard stand.

Numerous portable musical instrument stands have been provided in prior art that are adapted to be assembled for supporting instruments and disassembled for transportation or storage. For example, U.S. Pat. Nos. 4,634,090 to Currie et al, 4,684,091 to Moreschi and 4,763,865 to Danner all are illustrative of such prior art. While these units may be suitable for the particular purpose to which they address, they would not be as suitable for the purposes of the present invention as heretofore described.

SUMMARY OF THE INVENTION

A primary object of the present invention is to provide a kick-down keyboard stand that will overcome the shortcomings of the prior art devices.

Another object is to provide a knock-down keyboard stand in which the legs can be removed from the table top and be stored within a compartment in the bottom of the table top to make the stand compact when not in use.

An additional object is to provide a knock-down keyboard stand in which either two legs or one center leg can be utilized for supportively elevating the table top when a person uses a keyboard instrument thereon for playing.

A further object is to provide a knock-down keyboard stand that is simple and easy to use.

A still further object is to provide a knock-down keyboard stand that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OH THE PREFERRED EMBODIMENTS

Figure 1:
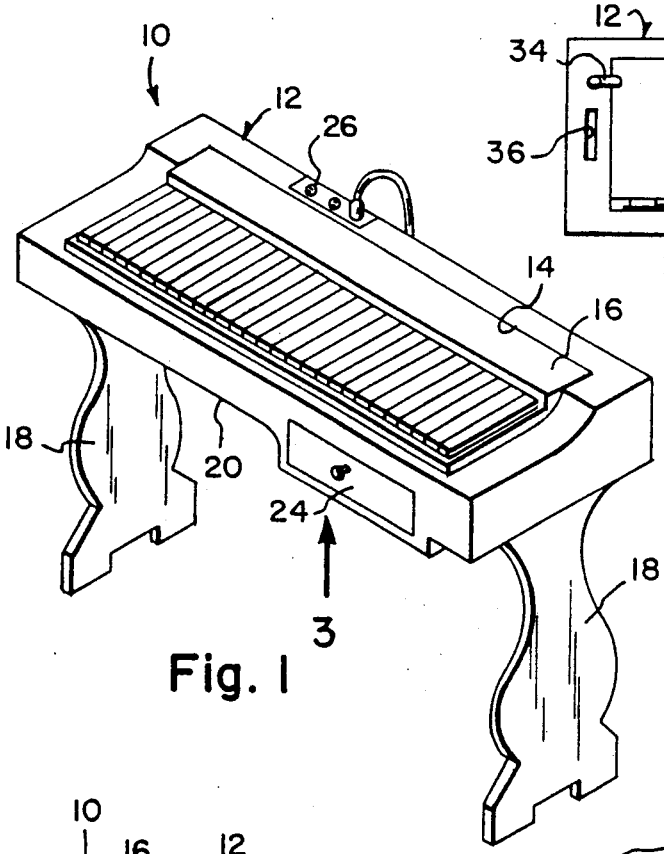
FIG. 1 is a perspective view of the invention.
Figure 3:
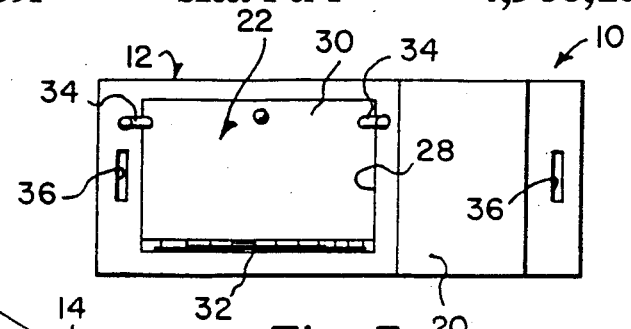
FIG. 3 is a bottom view of the table top showing the bottom compartment with door for storing the legs therein.
Figure 2:
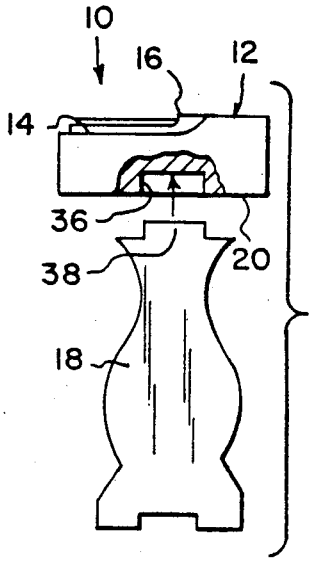
FIG. 2 is a side view thereof with parts broken away and leg removed therefrom.

Turning now descriptively to the drawings, in which similar reference characters denote similar elements throughout the several views FIGS. 1 through 3 illustrates a knock-down keyboard stand 10 consisting of a table top 12 having a recess 14 therein for holding a keyboard 16 therein. A pair of legs 18 are provided for supporting and elevating the table top 12. The legs 18 can be removably attached to the bottom 20 of he table top 12 in a spaced apart relationship. A storage area 22 is also provided within the bottom of the table top 12 after the legs 18 are moved from the table top.

The table to 12 further includes a drawer 24 for storing sheet music and various other items therein. An electrical outlet 26 is disposed in the table to for supplying power to the keyboard 16.

The storage area 22 includes a compartment 28 formed in the bottom 20 of the table top 12 and is sized to hold both of the legs 18 therein. A door 30 is hinged at 32 to the bottom 20 of the table to 12 to cover the compartment 28. Latches 34 can keep the door 30 in a closed position over the compartment 28. The bottom 20 of the table top 12 has two spaced apart slots 36 in which each slot receives a top end 38 of one of the legs 18.

Figure 4:
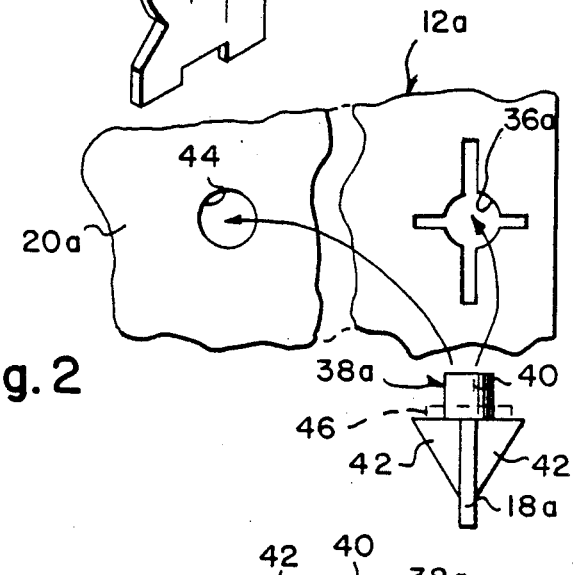
FIG. 4 is a bottom view with parts broken away of a modification showing a leg ready to be placed into either side hole or center hole.
Figure 5:
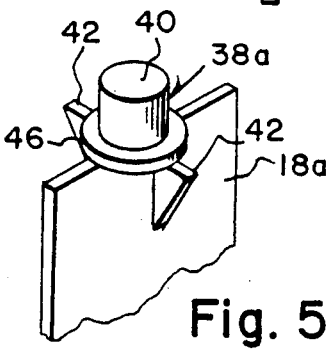
FIG. 5 is a perspective view of top portion of the modified leg with two stabilizers.
Figure 6:
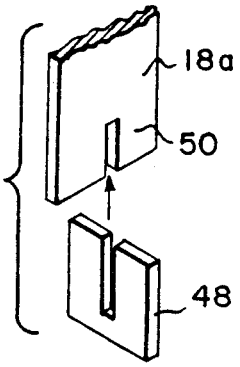
FIG. 6 is a perspective view of bottom portion of the modified leg showing a removable cross member to steady the leg ready to be placed thereon.

FIGS. 4, 5 and 6 show a modification wherein the bottom **20*a* of the table top 12** *a* has two spaced apart end slots **36*a*. Each slot 36*a* is of a configuration to receive a top end 38*a* which includes a post 40 and stabilizers 42 of one of the legs 18*a* in a on-rotatable condition. The bottom 20*a* of the table top 12*a* has a center circular aperture 44 being of a configuration to receive the post 40 of the top end 38*a* of one of the legs 18*a* in a rotatable condition. A washer 46 is used on the top end 38*a* of the leg 18*a* when used for the rotatable condition. A cross member 48 is removably attached to bottom end 50 of the leg 18*a*** when used for the rotatable condition.

While certain novel features of this invention have been shown and described and are pointed out in the annexed claims, it will be understood that various omissions, substitutions and changes in the forms and details of the device i illustrated and in its operation can be made by those skilled in the art without departing from the spirit of the invention.

What is claimed is:

1. A knock-down keyboard stand comprising:

(a) a table top having a recess therein for holding a keyboard therein;

(b) a pair of legs with top and bottom ends for supporting and elevating said table top;

(c) said table top having spaced apart end slots which receive top ends of said legs in non-rotatable condition for removably attaching said legs in a spaced apart relationship;

(d) a compartment within the bottom of said table top, for storing said legs therein after said legs are removed from said table top, further including a circular post with spaced stabilizers extending radially from a base of said post and a removable washer adapted to be mounted about said post on said stabilizers preventing said stabilizers from entering said slots whereby said legs can be converted for mounting rotatably to non-rotatably.

* * * * *